US011182983B2

(12) United States Patent
Higuchi et al.

(10) Patent No.: US 11,182,983 B2
(45) Date of Patent: Nov. 23, 2021

(54) SAME VEHICLE DETECTION DEVICE, TOLL COLLECTION FACILITY, SAME VEHICLE DETECTION METHOD, AND PROGRAM

(71) Applicant: MITSUBISHI HEAVY INDUSTRIES MACHINERY SYSTEMS, LTD., Kobe (JP)

(72) Inventors: Tatsuya Higuchi, Tokyo (JP); Kazuyoshi Kitajima, Tokyo (JP); Keiji Terasaka, Tokyo (JP)

(73) Assignee: MITSUBISHI HEAVY INDUSTRIES MACHINERY SYSTEMS, LTD., Kobe (JP)

( * ) Notice: Subject to any disclaimer, the term of this patent is extended or adjusted under 35 U.S.C. 154(b) by 523 days.

(21) Appl. No.: 16/083,729

(22) PCT Filed: Mar. 31, 2016

(86) PCT No.: PCT/JP2016/061639
§ 371 (c)(1),
(2) Date: Sep. 10, 2018

(87) PCT Pub. No.: WO2017/168764
PCT Pub. Date: Oct. 5, 2017

(65) Prior Publication Data
US 2019/0088038 A1 Mar. 21, 2019

(51) Int. Cl.
*G07B 15/06* (2011.01)
*G07B 15/00* (2011.01)
(Continued)

(52) U.S. Cl.
CPC ..... *G07B 15/063* (2013.01); *G07B 15/00* (2013.01); *G07B 15/06* (2013.01); *G08G 1/0175* (2013.01)

(58) Field of Classification Search
None
See application file for complete search history.

(56) References Cited

U.S. PATENT DOCUMENTS

2002/0140577 A1* 10/2002 Kavner ..... G07B 15/063 340/933
2011/0288909 A1* 11/2011 Hedley ..... G06K 9/00624 705/13
2015/0222632 A1* 8/2015 Ichijo ..... H04L 63/0876 726/7

FOREIGN PATENT DOCUMENTS

JP H08-315196 A 11/1996
JP H11-328576 A 11/1999
(Continued)

OTHER PUBLICATIONS

Mobility Investment Priorities, Electronic Toll Collection Systems, Mar. 10, 2016, retrieved from http://mobility.tamu.edu/mip/strategies-pdfs/traffic-management/technical-summary/Electronic-Toll-Systems-4-Pg.pdf (Year: 2016).*
(Continued)

*Primary Examiner* — Emmett K. Walsh
*Assistant Examiner* — Michelle E Carey
(74) *Attorney, Agent, or Firm* — Manabu Kanesaka; Benjamin Hauptman; Kenneth Berner

(57) ABSTRACT

Provided is a same vehicle detection device, including: a first license plate information acquisition unit configured to store, in a first recording unit, first license plate information acquired from an onboard unit installed in a vehicle; a second license plate information acquisition unit configured to store, in a second recording unit, second license plate information of the vehicle read in, based on an image captured by shooting a predetermined region including the license plate of the vehicle; and a same vehicle determination unit configured to determine whether the first license
(Continued)

plate information stored in the first recording device relates to the same vehicle as the second license plate information stored in the second recording device.

7 Claims, 9 Drawing Sheets

(51) Int. Cl.
*G08G 1/01* (2006.01)
*G08G 1/017* (2006.01)

(56) References Cited

FOREIGN PATENT DOCUMENTS

| | | | |
|---|---|---|---|
| JP | 2001-034799 | A | 2/2001 |
| JP | 2003-099825 | A | 4/2003 |
| JP | 2013-210975 | A | 10/2013 |
| JP | 2013-232110 | A | 11/2013 |

OTHER PUBLICATIONS

PCT/ISA/210, "International Search Report for International Application No. PCT/JP2016/061639," dated Jul. 19, 2016.
PCT/ISA/237, "Written Opinion of the International Searching Authority for International Application No. PCT/JP2016/061639," dated Jul. 19, 2016.

* cited by examiner

T1

ONBOARD UNIT INFORMATION TABLE

| No. | ACQUISITION DATE AND TIME | LANE | ONBOARD UNIT ID | FIRST NP INFORMATION | CREDIT CARD NUMBER |
|---|---|---|---|---|---|
| 1 | 2015/11/01 10:00 | L1 | 00000001 | AAAA | ********** |
| 2 | 2015/11/01 10:10 | L2 | 00000003 | BBBB | ********** |
| 3 | 2015/11/01 10:13 | L1 | 00000009 | DDDD | ********** |
| 4 | 2015/11/01 10:30 | L1 | 00000006 | EEEE | ********** |
| ⋮ | ⋮ | ⋮ | ⋮ | ⋮ | ⋮ |

FIG. 3

T2

CAMERA INFORMATION TABLE

| No. | ACQUISITION DATE AND TIME | LANE | SECOND NP INFORMATION |
|---|---|---|---|
| 1 | 2015/11/01 10:01 | L1 | AAAA |
| 2 | 2015/11/01 10:12 | L2 | CCCC |
| 3 | 2015/11/01 10:14 | L2 | DDDB |
| 4 | 2015/11/01 10:20 | L1 | FFFF |
| ⋮ | ⋮ | ⋮ | ⋮ |

FIG. 4

T3

IRREGULAR VEHICLE TABLE

| No. | ONBOARD UNIT INFORMATION | | | | CAMERA INFORMATION | | | DETAILS OF IRREGULARITY |
|---|---|---|---|---|---|---|---|---|
| | ACQUISITION DATE AND TIME | LANE | ONBOARD UNIT ID | FIRST NP INFORMATION | ACQUISITION DATE AND TIME | LANE | SECOND NP INFORMATION | |
| 1 | 2015/11/01 10 : 10 | L2 | 00000003 | BBBB | 2015/11/01 10 : 12 | L2 | CCCC | SWAP |
| 2 | – | – | – | – | 2015/11/01 10 : 20 | L1 | FFFF | NO OBU |
| 3 | 2015/11/01 10:30 | L1 | 00000006 | EEEE | – | – | – | SUSPECT OF SWAP |
| ⋮ | ⋮ | ⋮ | ⋮ | ⋮ | ⋮ | ⋮ | ⋮ | ⋮ |

FIG. 5

T10

ONBOARD UNIT REGISTRATION TABLE

| No. | ONBOARD UNIT ID | FIRST NP INFORMATION |
|---|---|---|
| 1 | 00000001 | AAAA |
| 2 | 00000003 | BBBB |
| 3 | 00000006 | EEEE |
| ⋮ | ⋮ | ⋮ |

FIG. 11

SAME VEHICLE DETECTION DEVICE, TOLL COLLECTION FACILITY, SAME VEHICLE DETECTION METHOD, AND PROGRAM

RELATED APPLICATIONS

The present application is National Phase of International Application No. PCT/JP2016/061639 filed Mar. 31, 2016, the disclosure of which is hereby incorporated by reference herein in its entirety.

TECHNICAL FIELD

The present invention relates to a same vehicle detection device, a toll collection facility, a same vehicle detection method, and a program.

BACKGROUND ART

To allow a vehicle to smoothly pass a tollgate on a toll road such as a highway, some tollgates employ a free flow system that can charge the vehicle without stopping it, by use of a wireless communication device that allows wireless communication between an onboard unit installed in a passing vehicle and a roadside charge processing device (see Patent Document 1, for example).

CITATION LIST

Patent Document

Patent Document 1: JP 2001-34799 A

SUMMARY OF INVENTION

Problem to be Solved by the Invention

In the above free flow system, the charging device acquires onboard unit information recorded in the onboard unit via the wireless communication device. Examples of the onboard unit information include an onboard unit ID for identifying an onboard unit, and license plate information for identifying a vehicle with the onboard unit. The charging device charges the onboard unit on the basis of the onboard unit ID, the license plate information, or the like included in the onboard unit information. Also, in some cases, the above free flow system is provided with a license plate reader that captures an image including a vehicle license plate with a camera and reads vehicle license plate information on the basis of the image. In this case, the charging device checks the license plate information of the onboard unit information against the license plate information acquired from the license plate reader to detect violation, or the like.

However, in the above free flow system, processing that the charging device acquires the onboard unit information from the onboard unit via the wireless communication device and the processing for acquiring the license plate information with the license plate reader may be performed in different orders or timings depending on the traffic on the toll road, or the like. For example, in a case where the vehicle decelerates due to traffic jam or the like, a long time may be required until the onboard unit information is acquired from the onboard unit via the wireless communication device from the processing that the charging device acquires vehicle license plate information with the license plate reader.

There is accordingly a demand for an effective solution capable of increasing accuracy of detecting onboard unit information and license plate information, which relate to the same vehicle, even in a case where the processing for acquiring the onboard unit information from the onboard unit and the processing for acquiring the license plate information with the license plate reader are performed at different timings.

The present invention has been made in view of the above problem, and an object thereof is to provide a same vehicle detection device, toll collection facility, same vehicle detection method, and program, which can detect information relating to the same vehicle from among plural information acquired at different timings with high accuracy.

Solution to Problem

A same vehicle detection device (210) according to a first aspect of the present invention includes:

a first license plate information acquisition unit (211) configured to acquire first license plate information of a vehicle (A) running on a lane (L1, L2), based on onboard unit information acquired through wireless communication with an onboard unit (10) installed in the vehicle, and store the first license plate information in a first recording unit (T1);

a second license plate information acquisition unit (213) configured to acquire second license plate information of the vehicle that is read in, based on an image captured by a camera (220) configured to shoot a predetermined region including a license plate of the vehicle, defined on the lane, and store the second license plate information in a second recording unit (T2); and a same vehicle determination unit (214) configured to determine whether the first license plate information stored in the first recording unit and the second license plate information stored in the second recording unit relate to the same vehicle.

In a case that the first license plate information is acquired, and the second license plate information matched with the first license plate information is recorded in the second recording unit, the same vehicle determination unit is configured to determine that the first license plate information and the second license plate information relate to the same vehicle. Also, in a case that the second license plate information is acquired, and the first license plate information matched with the second license plate information is recorded in the first recording unit, the same vehicle determination unit is configured to determine that the first license plate information and the second license plate information relate to the same vehicle.

With the above configuration, the same vehicle determination unit can detect with high accuracy a combination of first license plate information and second license plate information relating to the same vehicle among the first license plate information stored in the first recording unit and the second license plate information stored in the second recording unit regardless of the order or timing of acquisition of the first license plate information and second license plate information.

According to a second aspect of the present invention, in the above same vehicle detection device, in a case that the second license plate information matched with the first license plate information is not recorded in the second recording unit, the same vehicle determination unit is configured to determine that the second license plate information acquired at the same lane as a lane at which the first license plate information is acquired, within a predetermined period from acquisition time of the first license plate information, relates to the same vehicle as the first license plate information. Also, in a case that the first license plate information matched with the second license plate information is not recorded in the first recording unit, the same vehicle determination unit is configured to determine that the first license plate information acquired within a predetermined period from acquisition time of the second license plate information, at the same lane as a lane at which the second license plate information is acquired, relates to the same vehicle as the second license plate information.

With the above configuration, when a combination of matched first license plate information and second license plate information cannot be detected, the same vehicle determination unit determines that the first license plate information and second license plate information acquired within a predetermined time at the same lane, relate to the same vehicle. Thus, even in a case where there is a vehicle of which first license plate information and second license plate information are different because of exchange of the onboard unit, or the like, it is possible to determine whether the first license plate information and the second license plate information relate to the same vehicle. This enables the same vehicle determination unit to detect a combination of first license plate information and second license plate information relating to the same vehicle with higher accuracy.

According to a third aspect of the present invention, in the above same vehicle detection device, in a case that the second license plate information acquired within the predetermined period from the acquisition time of the first license plate information, at the same lane as the lane at which the first license plate information is acquired, is not recorded in the second recording unit, the same vehicle determination unit is configured to determine that the second license plate information matched with a part of the first license plate information relates to the same vehicle as the first license plate information. Also, in a case that the first license plate information acquired within the predetermined period from the acquisition time of the second license plate information, at the same lane as a lane at which the second license plate information is acquired, is not recorded in the first recording unit, the same vehicle determination unit is configured to determine that the first license plate information matched with a part of the second license plate information relates to the same vehicle as the second license plate information.

With the above configuration, when there is first license plate information matched with a part of the second license plate information, the same vehicle determination unit determines that the second license plate information and the first license plate information relate to the same vehicle. Thus, even in a case where a part of the second license plate information could not be correctly read because of a dirty license plate of the vehicle or the like, it is possible to determine that the first license plate information and the second license plate information relate to the same vehicle. This enables the same vehicle determination unit to detect a combination of first license plate information and second license plate information relating to the same vehicle with higher accuracy.

According to a fourth aspect of the present invention, in the above same vehicle detection device, in a case that the first license plate information and the second license plate information, determined to relate to the same vehicle, are not matched, the same vehicle determination unit is configured to determine that the vehicle is an irregular vehicle.

With the above configuration, the same vehicle determination unit determines that a vehicle of which first license plate information and second license plate determined to relate to the same vehicle are different, is an irregular vehicle. Thus, the same vehicle detection device can detect as an irregular vehicle a vehicle of which first license plate information and second license plate information are different because of exchange of the onboard unit or the like.

A toll collection facility (20) according to a fifth aspect of the present invention includes:

a wireless communication device (200) configured to perform wireless communication with an onboard unit installed in a vehicle running on a lane;

a license plate reader (230) configured to read license plate information of the vehicle, based on an image captured by a camera configured to shoot a predetermined region including a license plate of the vehicle, defined on the lane;

the same vehicle detection device according to any one of the above aspects; and a charging device (240) configured to charge the vehicle, based on at least one of onboard unit information of the onboard unit acquired via the wireless communication device and license plate information of the vehicle read by the license plate reader.

A same vehicle detection method according to a sixth aspect of the present invention includes:

a first license plate information acquisition step for acquiring first license plate information of a vehicle running on a lane, based on onboard unit information acquired through wireless communication with an onboard unit installed in the vehicle, and storing the first license plate information in a first recording unit;

a second license plate information acquisition step for acquiring second license plate information of the vehicle which is read in, based on an image captured by a camera configured to shoot a predetermined region including a license plate of the vehicle, defined on the lane, and for storing the second license plate information in a second recording unit; and a same vehicle determination step for determining whether the first license plate information stored in the first recording unit and the second license plate information stored in the second recording unit relate to the same vehicle.

In the same vehicle determination step, in a case that the first license plate information is acquired, and the second license plate information matched with the first license plate information is recorded in the second recording unit, it is determined that the first license plate information and the second license plate information relate to the same vehicle. Also, in the same vehicle determination step, in a case that the second license plate information is acquired, and the first license plate information matched with the second license plate information is recorded in the first recording unit, it is determined that the first license plate information and the second license plate information relate to the same vehicle.

A program according to a seventh aspect of the present invention causes a computer of a same vehicle detection device to function as:

a first license plate information acquisition unit configured to acquire first license plate information of a vehicle running on a lane, based on onboard unit information acquired through wireless communication with an onboard unit installed in the vehicle, and store the first license plate information in a first recording unit;

a second license plate information acquisition unit configured to acquire second license plate information of the vehicle which is read in, based on an image captured by a camera configured to shoot a predetermined region including a license plate of the vehicle, defined on the lane, and store the second license plate information in a second recording unit; and a same vehicle determination unit configured to determine whether the first license plate information stored in the first recording unit and the second license plate information stored in the second recording unit relate to the same vehicle.

In a case that the first license plate information is acquired, and the second license plate information matched with the first license plate information is recorded in the second recording unit, the same vehicle determination unit is configured to determine that the first license plate information and the second license plate information relate to the same vehicle. Also, in a case that the second license plate information is acquired, and the first license plate information matched with the second license plate information is recorded in the first recording unit, the same vehicle determination unit is configured to determine that the first license plate information and the second license plate information relate to the same vehicle.

Advantageous Effect of Invention

According to the aforementioned same vehicle detection device, toll collection facility, same vehicle detection method, and program, it is possible to detect information relating to the same vehicle from among a plurality of pieces of information acquired at different timings with high accuracy.

BRIEF DESCRIPTION OF DRAWINGS

FIG. 3 shows an example of an onboard unit information table according to the first embodiment of the present invention.

FIG. 4 shows an example of a camera information table according to the first embodiment of the present invention.

FIG. 5 shows an example of an irregular vehicle table according to the first embodiment of the present invention.

FIG. 11 shows an example of an onboard unit registration table according to a modification of the first embodiment of the present invention.

DESCRIPTION OF EMBODIMENTS

First Embodiment

Hereinafter, a toll collection system 1 according to a first embodiment will be described with reference to FIGS. 1 to 9.

Overall Configuration of Toll Collection System

Figure 1:
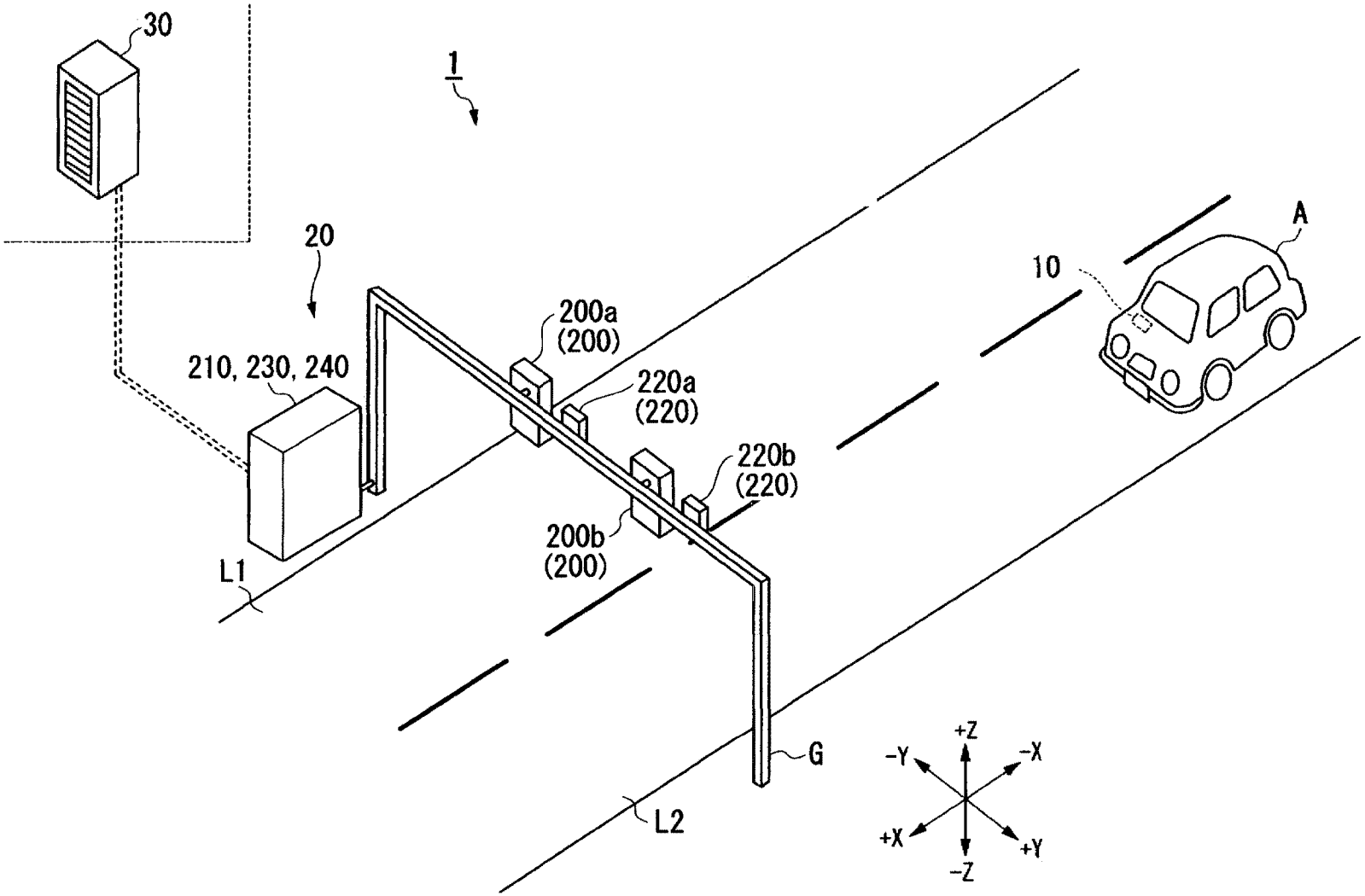
FIG. 1 is a diagram illustrating an overall configuration of a toll collection system according to a first embodiment of the present invention.

FIG. 1 is a diagram illustrating an overall configuration of a toll collection system according to the first embodiment of the present invention.

A toll collection system 1 of this embodiment is an electronic toll collection system installed on a main line of a toll road with a plurality of lanes (hereinafter also referred to as "main road"). Note that this embodiment is described of such a mode that the toll road has two lanes L1 and L2. Also, the description is given of such a mode that the toll collection system 1 is provided at an exit tollgate of the toll road.

As illustrated in FIG. 1, the toll collection system 1 includes an onboard unit 10, a toll collection facility 20, and a management server 30.

In the toll collection system 1 of this embodiment, the onboard unit 10 installed in a vehicle A running on the main road (lanes L1 and L2) and the toll collection facility 20 provided by the roadside of the main road (lanes L1 and L2) transmit and/or receive information and instructions via wireless communication.

The toll collection facility 20 includes a wireless communication device 200, a same vehicle detection device 210, a camera 220, a license plate (NP) reader 230, and a charging device 240.

The wireless communication device 200 is attached to a gantry G provided across the lanes L1 and L2 in the lane width direction (±Y direction in FIG. 1), and secured above the lanes L1 and L2. The wireless communication device 200 transmits and/or receives information and instructions to/from the onboard unit 10 via wireless communication.

In this embodiment, described is a mode in which the toll collection facility 20 has one wireless communication device 200 for each lane. Specifically, as illustrated in FIG. 1, the wireless communication devices 200*a* and 200*b* are provided for the lanes L1 and L2, respectively. The wireless communication device 200*a* performs wireless communication by a radio wave with the onboard unit 10 installed in the vehicle A within a predetermined communication region defined on the road surface of the lane L1. The wireless communication device 200*b* performs wireless communication by a radio wave with the onboard unit 10 installed in the vehicle A within a predetermined communication region defined on the road surface of the lane L2.

Note that in this embodiment, the wireless communication device 200 (wireless communication device 200*a*, 200*b*) performs wireless communication with the onboard unit 10 by means of Radio Frequency Identifier (RFID) communication, Dedicated Short Range Communication (DSRC), or the like.

The camera 220 is attached to the gantry G and secured above the lanes L1 and L2. The camera 220 sequentially captures an image of the region defined on the road surface of the lanes L1 and L2 at regular intervals (for example, every second) and executes image processing on the captured images so as to detect vehicle's coining. Then, after the detection of the vehicle's coming, the camera shoots a predetermined image capturing region including license plates of vehicles running on the lanes L1 and L2 to capture the images including the license plates of vehicles running on the lanes L1 and L2 as images for reading license plate information.

This embodiment is described of such a mode that the toll collection facility 20 has one camera 220 for each lane. Specifically, as illustrated in FIG. 1, a camera 220*a* is provided for the lane L1, and the camera 220*a* shoots a predetermined image capturing region defined on the lane L1. Also, a camera 220*b* is provided for the lane L2, and the camera 220*b* shoots a predetermined image capturing region defined on the lane L2.

The license plate reader 230 acquires "camera information" of the vehicle A running on the lanes L1 and L2 on the basis of the image captured with the camera 220. The "camera information" is information including "license plate information" as vehicle registration information for identifying the vehicle A, and "acquisition date and time" of the "license plate information", and its corresponding "lane".

The same vehicle detection device 210 is communicably connected by cable with the wireless communication device 200 and the license plate reader 230, and acquires "onboard unit information" via the wireless communication device 200 from the onboard unit 10 and also acquires "camera information" of the vehicle A via the license plate reader 230.

The "onboard unit information" is information including "onboard unit ID", "license plate information (hereinafter referred to as first license plate information)", "credit card number", "acquisition date" of the "onboard unit ID" or the like acquired from the onboard unit 10, and its corresponding "lane". Note that the "onboard unit ID" is recorded beforehand in the onboard unit 10 and can be used for identifying the onboard unit 10. The "first license plate information" is information (vehicle registration information or the like) that has been recorded beforehand in the onboard unit 10 and can be used for identifying the vehicle A with the onboard unit 10. The "credit card number" is information indicating the number of a credit card inserted to the onboard unit 10.

The same vehicle detection device 210 detects, on the basis of the "onboard unit information" acquired from the onboard unit 10 and the "camera information" acquired with the license plate reader 230, one of the vehicles running on the lanes L1 and L2, associated with the "onboard unit information" and one of these vehicles, associated with the "camera information", which are considered matched.

The charging device 240 is installed by the roadside of the lanes L1 and L2 around the gantry G. The charging device 240 is communicably connected by cable with the same vehicle detection device 210, and calculates a toll charged to the vehicle A passing the toll road and performs charging processing for collecting the toll on the basis of at least one of the "onboard unit information" and "camera information" acquired by the same vehicle detection device 210.

The management server 30 is communicably connected to the toll collection facility 20 via a wide area network or the like.

Functional Configuration of Toll Collection Facility

Referring to FIGS. 2 to 5, a functional configuration of the toll collection facility 20 according to this embodiment will be described next.

Figure 2:
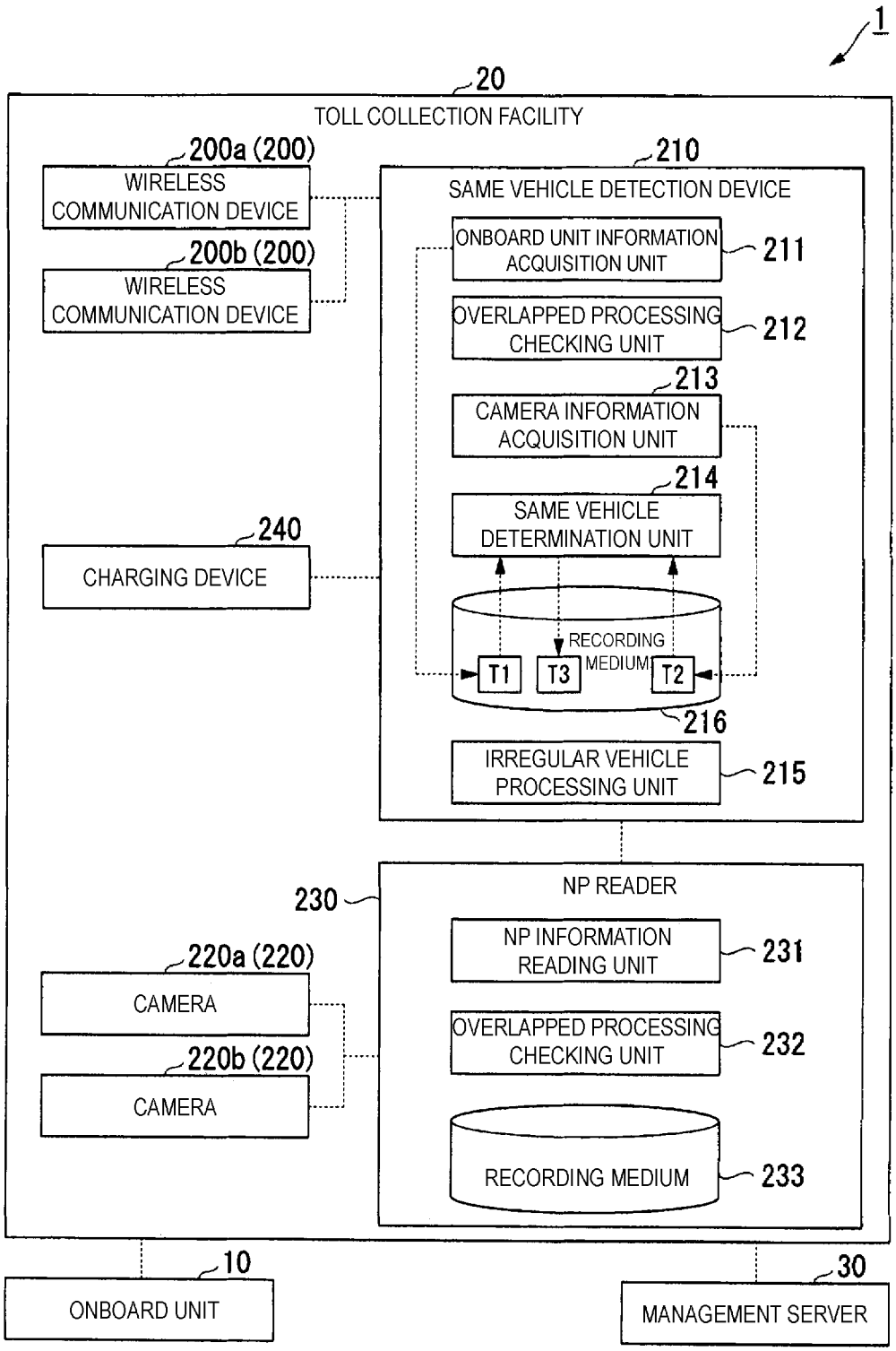
FIG. 2 is a diagram illustrating a functional configuration of a toll collection facility according to the first embodiment of the present invention.

FIG. 2 is a diagram illustrating the functional configuration of the toll collection facility according to the first embodiment.

As illustrated in FIG. 2, the license plate reader 230 of the toll collection facility 20 includes a license plate information reading unit 231, an overlapped processing checking unit 232, and a recording medium 233.

The license plate information reading unit 231 obtains an image captured by the camera 220 and executes predetermined image recognition processing on the image to read "license plate information (hereinafter referred to as second license plate information)" of the vehicle A. The predetermined image recognition processing is, for example, Optical Character Recognition (OCR) processing. Also, the license plate information reading unit 231 records, in the recording medium 233, "camera information" in which the read "second license plate information", the date and time at which the image including the "second license plate information" is captured (acquisition date and time), and its corresponding lane are associated.

When "new camera information" is recorded on the recording medium 233, the overlapped processing checking unit 232 checks whether the "second license plate information" of which the value is the same as the "second license plate information" of the "new camera information", is duplicately recorded in the recording medium 233. Also, when the same "second license plate information" is duplicately recorded in the recording medium 233, the overlapped processing checking unit 232 deletes the "camera information" including the "new second license plate information".

On the other hand, when the same "second license plate information" is not recorded in the recording medium 233, the overlapped processing checking unit 232 transmits the "new camera information" to the same vehicle detection device 210.

FIG. 3 shows an example of an onboard unit information table according to the first embodiment of the present invention.

As illustrated in FIG. 2, the same vehicle detection device 210 includes an onboard unit information acquisition unit (first license plate information acquisition unit) 211, an overlapped processing checking unit 212, a camera information acquisition unit (second license plate information acquisition unit) 213, a same vehicle determination unit 214, an irregular vehicle processing unit 215, and a recording medium 216.

The onboard unit information acquisition unit 211 acquires "onboard unit ID", "first license plate information", and "credit card number" via the wireless communication device 200 from the onboard unit 10.

Then, as illustrated in FIG. 3, the onboard unit information acquisition unit 211 records and stores "onboard unit information" in which the acquired "onboard unit ID", "first license plate information", and "credit card number", and the date and time ("acquisition date and time") at which the information is acquired and its corresponding lane are associated, in an onboard unit information table (first recording unit) T1 of the recording medium 216.

When "new onboard unit information" is recorded in the onboard unit information table T1, the overlapped processing checking unit 212 checks whether "first license plate information" of which the value is the same as the "first license plate information" of the "new onboard unit information" is duplicately recorded in the onboard unit information table T1.

When the same "first license plate information" is duplicately recorded in the onboard unit information table T1, the overlapped processing checking unit 212 deletes the "new onboard unit information" from the onboard unit information table T1.

On the other hand, in a case where the same "first license plate information" is not recorded in the onboard unit information table T1, the overlapped processing checking unit 212 notifies the same vehicle determination unit 214 that the "new onboard unit information" is recorded in the onboard unit information table T1.

FIG. 4 shows an example of the camera information table according to the first embodiment of the present invention.

The camera information acquisition unit 213 acquires "camera information" from the license plate reader 230 and records and stores it in a camera information table (second recording unit) T2 of the recording medium 216.

Specifically, as illustrated in FIG. 4, the camera information acquisition unit 213 records and stores "camera information" acquired from the license plate reader 230 ("second license plate information", "acquisition date and time", and "lane") in the camera information table T2.

Also, the camera information acquisition unit 213 notifies the same vehicle determination unit 214 that the "camera information" is recorded in the camera information table T2.

The same vehicle determination unit 214 determines, on the basis of the "onboard unit information" stored in the onboard unit information table T1 and the "camera information" stored in the camera information table T2, which "onboard unit information" and which "camera information" relate to the same vehicle among a plurality of vehicles running on the lanes L1 and L2.

Also, the same vehicle determination unit 214 deletes the "onboard unit information" and "camera information" being determined to relate to the same vehicle, from the onboard unit information table T1 and the camera information table T2.

FIG. 5 shows an example of an irregular vehicle table according to the first embodiment of the present invention.

When the "first license plate information" and "second license plate information" of the "onboard unit information" and "camera information" being determined to relate to the same vehicle A, are not matched, the same vehicle determination unit 214 determines the vehicle A as an irregular vehicle.

Also, in a case where the "camera information" relating to the same vehicle A as a vehicle indicated by the "onboard unit information" is not recorded in the camera information table T2, the same vehicle determination unit 214 determines the vehicle A as an irregular vehicle.

Furthermore, in a case where the "onboard unit information" relating to the same vehicle A as a vehicle indicated by the "camera information" is not recorded in the onboard unit information table T1, the same vehicle determination unit 214 determines the vehicle A as an irregular vehicle.

As illustrated in FIG. 5, the same vehicle determination unit 214 records and stores in an irregular vehicle table T3 of the recording medium 216, at least one of the onboard unit information" and "camera information" relating to the vehicle A determined to be an irregular vehicle and "details of irregularity" as "irregular vehicle information". In this embodiment, one of "onboard unit exchange (SWAP)" indicating that the onboard unit 10 is moved to a vehicle different from the vehicle identified by the "first license plate information", "suspected exchange of onboard unit (SUSPECT OF SWAP)" indicating the possibility that the onboard unit 10 is moved to a vehicle different from the vehicle identified by the "first license plate information", and "no onboard unit (NO OBU (NO ON-BOARD UNIT))" indicating that a target vehicle has no onboard unit 10 is recoded in "details of irregularity".

The processing of the same vehicle determination unit 214 will be described in detail later.

The irregular vehicle processing unit 215 transmits the "irregular vehicle information" to the management server 30 via a wide area network or the like. An administrator or the like of the toll road performs additional charging processing for each irregular vehicle, prohibits the usage of the onboard unit 10, and the like on the basis of the transmitted "irregular vehicle information".

Processing Flow in Toll Collection Facility

Referring to FIGS. 6 to 9, a processing flow in the toll collection facility 20 according to this embodiment is described next.

Figure 6:
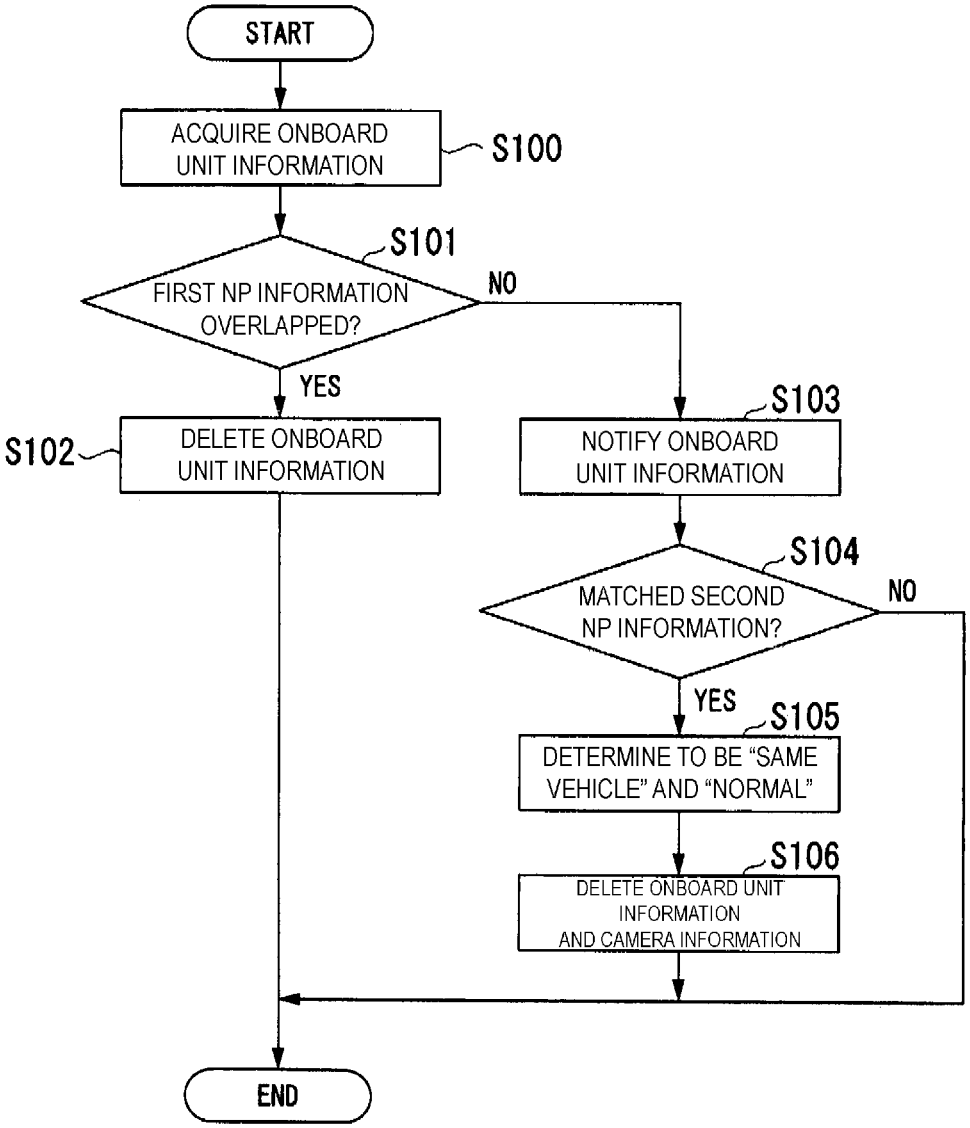
FIG. 6 is a first diagram illustrating a processing flow of a toll collection facility according to the first embodiment of the present invention.

FIG. 6 is a first diagram illustrating a processing flow in the toll collection facility according to the first embodiment of the present invention.

Referring to FIG. 6, a description is given below of processing to be performed when the same vehicle detection device 210 of the toll collection facility 20 acquires the "onboard unit information".

As illustrated in FIG. 6, the onboard unit information acquisition unit 211 acquires the "onboard unit information" about the onboard unit 10 (step S100). Specifically, the onboard unit information acquisition unit 211 acquires the "onboard unit ID", the "first license plate information", and the "credit card number" via the wireless communication device 200 from the onboard unit 10. Also, the onboard unit information acquisition unit 211 records and stores the acquired "onboard unit ID", "first license plate information" and "credit card number" in association with the "acquisition date and time" of the "onboard unit ID" or the like and its corresponding "lane", as the "onboard unit information" in the onboard unit information table T1 (FIG. 3) of the recording medium 216.

Next, the overlapped processing checking unit 212 checks whether the same "first license plate information" is duplicately recorded in the onboard unit information table T1 (step S101).

Specifically, when the onboard unit information acquisition unit 211 records the "new onboard unit information" in the onboard unit information table T1, the overlapped processing checking unit 212 extracts "past onboard unit information" that has been recorded within a predetermined time (for example, within five minutes) from the "acquisition date and time" of the "new onboard unit information". In a case where any one of the extracted "past onboard unit information" has the same value as the "first license plate information" of the "new onboard unit information", the overlapped processing checking unit 212 determines the "first license plate information" is duplicately recorded in the onboard unit information table T1 (YES instep S101). In this case, the overlapped processing checking unit 212 deletes the overlapped "new onboard unit information" from the onboard unit information table T1 (step S102) and terminates the processing. Through the above processing, the overlapped processing checking unit 212 avoids such a situation that the same "first license plate information" is duplicately recorded in the onboard unit information table T1.

On the other hand, in a case where none of the extracted "past onboard unit information" has the same value as the "first license plate information" of the "new onboard unit information", the overlapped processing checking unit 212 determines that the "first license plate information" is not duplicately recorded in the onboard unit information table T1 (NO in step S101). In this case, the overlapped processing checking unit 212 notifies the same vehicle determination unit 214 that the "new onboard unit information" is recorded in the onboard unit information table T1 (step S103).

Next, the same vehicle determination unit 214 determines whether the "camera information" including the "second license plate information" that matches the "first license plate information" of the "onboard unit information" recorded newly in the onboard unit information table T1, is recorded in the camera information table T2 (step S104).

In a case where the "camera information" including the "second license plate information" that matches the "first license plate information" of the "onboard unit information" is recorded in the camera information table T2 (YES in step S104), the same vehicle determination unit 214 proceeds to subsequent step S105.

On the other hand, in a case where the "camera information" including the "second license plate information" that matches the "first license plate information" of the "onboard unit information" is not recorded in the camera information table T2 (NO in step S104), the same vehicle determination unit 214 terminates the processing.

Next, in a case where the "camera information" including the "second license plate information" that matches the "first license plate information" of the "onboard unit information" is recorded in the camera information table T2 (YES in step S104), the same vehicle determination unit 214 determines that the "onboard unit information" and the "camera information" relate to the same vehicle A and the "onboard unit information" and "camera information" of the vehicle A are "normal" (step S105).

For example, a description is given of processing of the same vehicle determination unit 214 when "onboard unit information No. 1" (FIG. 3) is newly recorded in the onboard unit information table T1. The same vehicle determination unit 214 searches the camera information table T2 for the "second license plate information" that matches the "first license plate information" ("AAAA") of the "onboard unit information No. 1". In this case, the "second license plate information" ("AAAA") of the "camera information No. 1" (FIG. 4) in the camera information table T2 matches the "first license plate information" of the "onboard unit information No. 1" (step S104). Thus, the same vehicle determination unit 214 determines that the "onboard unit information No. 1" and the "camera information No. 1" relate to the same vehicle A and the vehicle A is "normal" (step S105).

Next, the same vehicle determination unit 214 deletes from the onboard unit information table T1 and the camera information table T2, the "onboard unit information" ("onboard unit information No. 1" of FIG. 3) and the "camera information" ("camera information No. 1" of FIG. 4) which are determined to relate to the same vehicle A (step S106), and terminates the processing.

Figure 7:
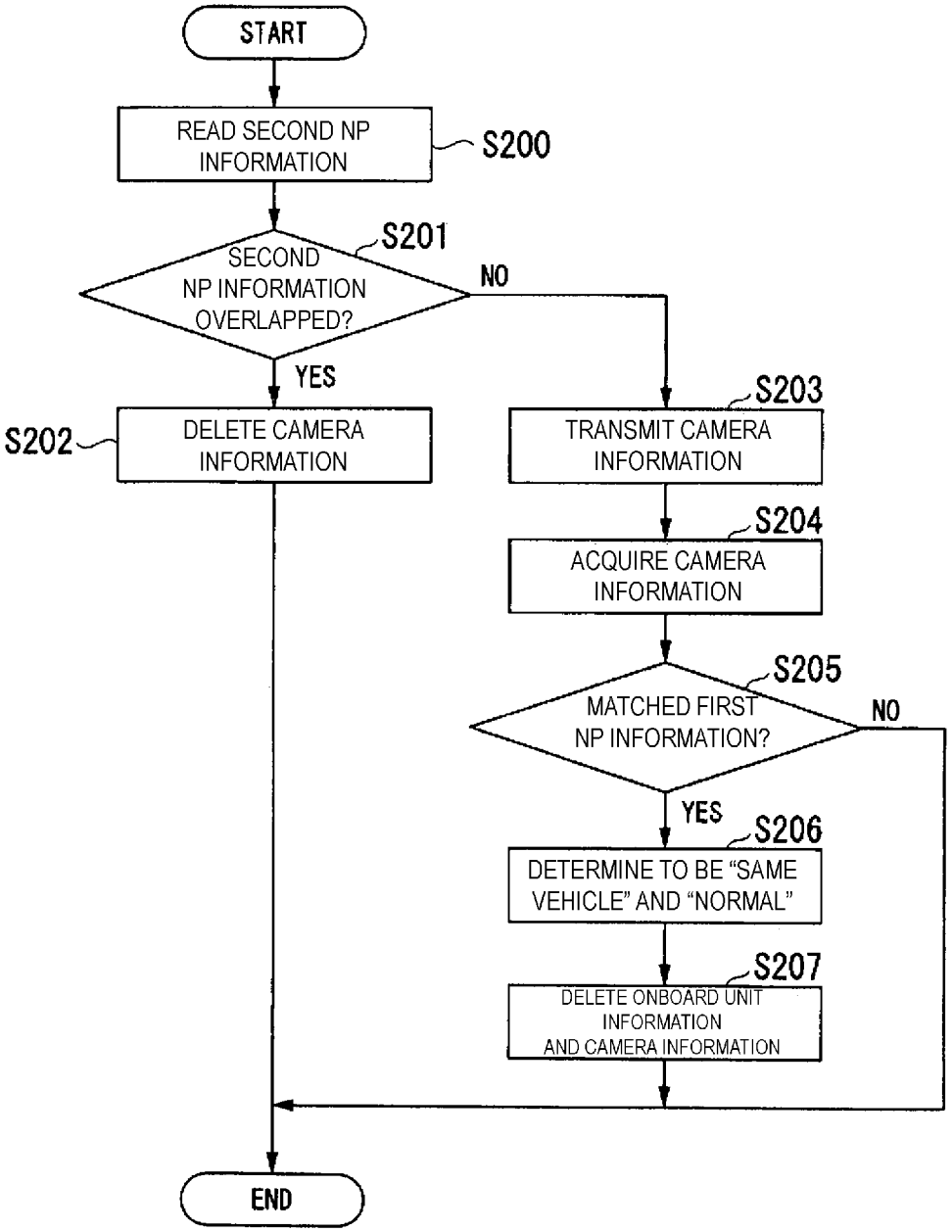
FIG. 7 is a second diagram illustrating a processing flow of a toll collection facility according to the first embodiment of the present invention.

FIG. 7 is a second diagram illustrating a processing flow of the toll collection facility according to the first embodiment of the present invention.

Referring to FIG. 7, described below is the processing in which the toll collection facility 20 acquires the "camera information".

As illustrated in FIG. 7, the license plate information reading unit 231 of the license plate reader 230 reads the "second license plate information" of the vehicle A on the basis of images captured with the camera 220 (step S200). Also, the license plate information reading unit 231 records the read "second license plate information" and the "camera information" in association with the date and time (acquisition date and time) at which the image including the "second license plate information" is captured and its corresponding "lane" in the recording medium 233.

Next, the overlapped processing checking unit 232 of the license plate reader 230 checks whether the same "second license plate information" is duplicately recorded in the recording medium 233 (step S201).

Specifically, when the license plate information reading unit 231 records "new camera information" in the recording medium 233, the overlapped processing checking unit 232 extracts "past camera information" that has been recorded within a predetermined time (for example, within five minutes) from the "acquisition date and time" of the "new camera information". In a case where any one of the extracted "past camera information" has the same value as the "second license plate information" of the "new camera information", the overlapped processing checking unit 232 determines that the "second license plate information" is duplicately recorded in the recording medium 233 (YES in step S201). In this case, the overlapped processing checking unit 232 deletes the "new camera information" from the recording medium 233 (step S202), and terminates the processing. Through the above processing, the overlapped processing checking unit 232 avoids such a situation that the same "second license plate information" is duplicately recorded in the recording medium 233.

On the other hand, in a case where none of the extracted "past camera information" has the same value as the "second license plate information" of the "new camera information", the overlapped processing checking unit 232 determines that the "second license plate information" is not duplicately recorded in the recording medium 233 (NO in step S201). In this case, the overlapped processing checking unit 232 transmits the "new camera information" to the same vehicle detection device 210 (step S203).

Next, the camera information acquisition unit 213 of the same vehicle detection device 210 acquires the "camera information" from the license plate reader 230 (step S204). The camera information acquisition unit 213 records and stores the "camera information" in the camera information table T2. Also, the camera information acquisition unit 213 notifies the same vehicle determination unit 214 that the "camera information" is recorded in the camera information table T2.

Next, the same vehicle determination unit 214 of the same vehicle detection device 210 determines whether "onboard unit information" having "first license plate information" that matches "second license plate information" of the "camera information", is recorded in the onboard unit information table T1 (step 205).

When the "onboard unit information" having "first license plate information" that matches "second license plate information" of the "camera information" is recorded in the onboard unit information table T1 (YES in step S205), the same vehicle determination unit 214 proceeds to subsequent step S206.

On the other hand, when the "onboard unit information" having "first license plate information" that matches "second license plate information" of the "camera information" is not recorded in the onboard unit information table T1 (NO in step S205), the same vehicle determination unit 214 terminates the processing.

Next, when the "onboard unit information" having "first license plate information" that matches "second license plate information" of the "camera information" is recorded in the onboard unit information table T1 (YES in step S205), the same vehicle determination unit 214 determines that the "onboard unit information" and the "camera information" relate to the same vehicle A, and the vehicle A is "normal" (step S206).

Next, the same vehicle determination unit 214 deletes the "onboard unit information" and "camera information" which are determined to relate to the same vehicle A, from the onboard unit information table T1 and the camera information table T2 (step S207), and then terminates the processing.

Figure 8:
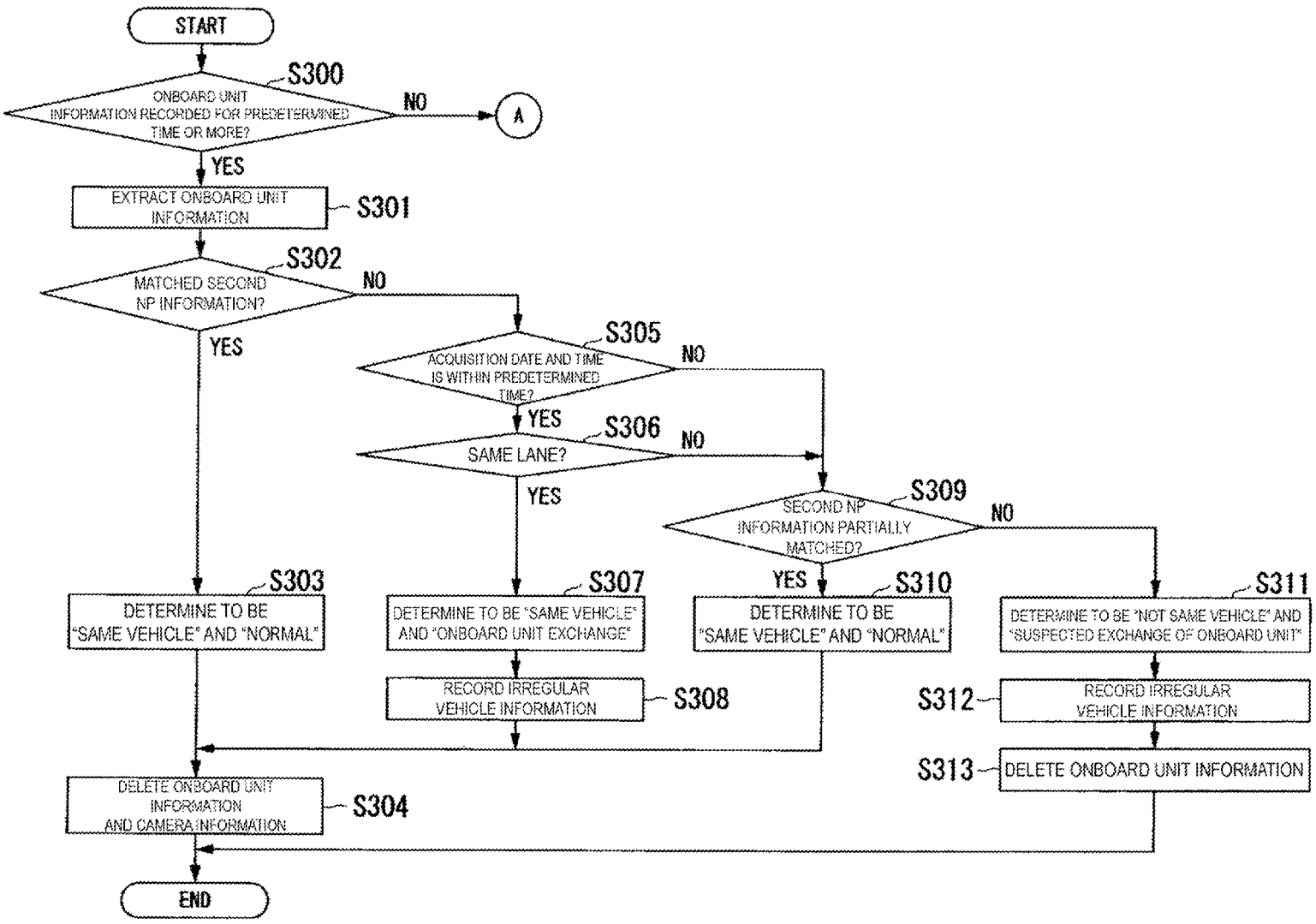
FIG. 8 is a third diagram illustrating a processing flow of a toll collection facility according to the first embodiment of the present invention.

FIG. 8 is a third diagram illustrating a processing flow of the toll collection facility according to the first embodiment of the present invention.

Figure 9:
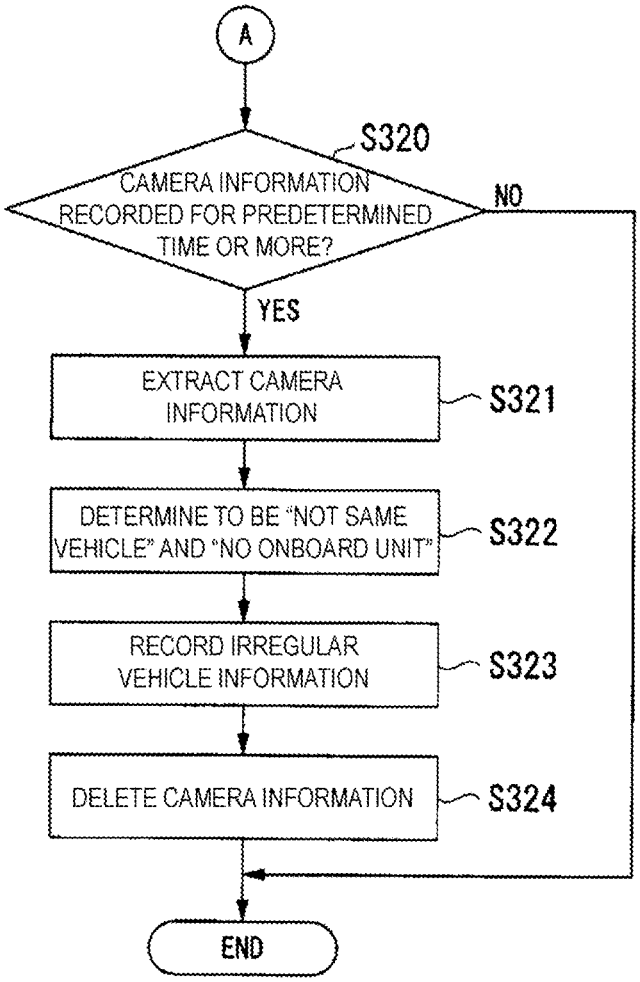
FIG. 9 is a fourth diagram illustrating a processing flow of a toll collection facility according to the first embodiment of the present invention.

FIG. 9 is a fourth diagram illustrating a processing flow of the toll collection facility according to the first embodiment of the present invention.

Referring to FIGS. 8 and 9, described below is a processing executed by the same vehicle detection device 210 of the toll collection facility 20 during a period in which "onboard unit information" or "camera information" is not acquired. Note that in this embodiment, the same vehicle detection device 210 repeats the processing of FIGS. 8 and 9 at regular intervals of predetermined time (for example, every minute).

As illustrated in FIG. 8, the same vehicle determination unit 214 of the same vehicle detection device 210 determines whether the onboard unit information table T1 includes "onboard unit information" being recorded beforehand for a predetermined time limit or more (for example, five minutes or more) (step S300).

When the onboard unit information table T1 includes "onboard unit information" being recorded for a predetermined time limit or more (YES in step S300), the same vehicle determination unit 214 extracts the "onboard unit information" (step S301).

On the other hand, when the onboard unit information table T1 does not include "onboard unit information" being recorded for a predetermined time limit or more (NO in step S300), the same vehicle determination unit 214 proceeds to processing A of FIG. 9.

The same vehicle determination unit 214 determines whether the "camera information" having "second license plate information" that matches the "first license plate information" of the "onboard unit information", extracted in step S301, is recorded in the camera information table T2 (step S302).

When the "camera information" having "second license plate information" that matches the "first license plate information" of the "onboard unit information" is recorded in the camera information table T2 (YES in step S302), the same vehicle determination unit 214 determines that the "onboard unit information" and the "camera information" related to the same vehicle A, and the "onboard unit information" and "camera information" relating to the vehicle A is "normal" (step S303). In this case, the same vehicle determination unit 214 deletes the "onboard unit information" and "camera information" being determined to relate to the same vehicle A, from the onboard unit information table T1 and the camera information table T2 (step S304), and terminates the processing.

On the other hand, when the "camera information" having "second license plate information" that matches the "first license plate information" of the "onboard unit information" is not recorded in the camera information table T2 (NO in step S302), the same vehicle determination unit 214 proceeds to step 305.

Next, the same vehicle determination unit 214 determines whether "camera information" including "acquisition date and time" that is within a predetermined time (for example, within five minutes) from the "acquisition date and time" of the "onboard unit information" is recorded in the camera information table T2 (step S305).

When the "camera information" including "acquisition date and time" that is within a predetermined time from the "acquisition date and time" of the "onboard unit information" is not recorded in the camera information table T2 (NO in step S305), the same vehicle determination unit 214 proceeds to step S309.

On the other hand, when the "camera information" including "acquisition date and time" that is within a predetermined time from the "acquisition date and time" of the "onboard unit information" is recorded in the camera information table T2 (YES in step S305), the same vehicle determination unit 214 further determines whether the "onboard unit information" and the "camera information" have been acquired at the same "lane" (step S306).

When the "lane" of the "onboard unit information" and the "lane" of the "camera information" are different (NO in step S306), the same vehicle determination unit 214 proceeds to step S309.

On the other hand, when the "lane" of the "onboard unit information" and the "lane" of the "camera information" are the same (YES in step S306), the same vehicle determination unit 214 determines that the "onboard unit information" and the "camera information" relate to the same vehicle A. Also, the same vehicle determination unit 214 determines that the vehicle A is an irregular vehicle ("onboard unit exchange (SWAP)") (step S307) because the "first license plate information" of the "onboard unit information" and the "second license plate information" of the "camera information" are not matched. Specifically, the same vehicle determination unit 214 determines that the onboard unit 10 with this "onboard unit information" is moved to a vehicle (vehicle with "second license plate information") different from the vehicle identified by the "first license plate information" being recorded beforehand in the onboard unit 10.

For example, a description is given of the case that the same vehicle determination unit 214 extracts the "onboard unit information No. 2" of the onboard unit information table T1 (FIG. 3) in step S301. The same vehicle determination unit 214 searches the camera information table T2 for "camera information" acquired within a predetermined time from "acquisition date and time" ("2015/11/01 10:10") of the "onboard unit information No. 2". In this case, "camera information No. 2" of the camera information table T2 (FIG. 4) has been acquired within a predetermined time from the "acquisition date and time" of the "onboard unit information No. 2" ("2015/11/01 10:12") (YES in step S305). Also, since the "lane" ("L2") of the "onboard unit information No. 2" and the "lane" ("L2") of the "camera information No. 2" are the same (YES in step S306), the same vehicle determination unit 214 determines that the "onboard unit information No. 2" and the "camera information No. 2" relate to the same vehicle A. Then, the same vehicle determination unit 214 determines that the vehicle A is an irregular vehicle ("onboard unit exchange (SWAP)") (step S307) because the "first license plate information" ("BBBB") of the "onboard unit information No. 2" and the "second license plate information ("CCCC") of the "camera information No. 2" are not matched.

Next, as illustrated in FIG. 5, the same vehicle determination unit 214 records information in which the "onboard unit information" ("onboard unit information No. 2" of FIG. 3) and "camera information" ("camera information No. 2" of FIG. 4) determined to relate to the same vehicle A are associated with "details of irregularity" ("onboard unit exchange (SWAP)") of the vehicle A determined to be an irregular vehicle, in the irregular vehicle table T3 ("irregular vehicle information No. 1" of FIG. 5) as "irregular vehicle information" (step S308).

Then, the same vehicle determination unit 214 deletes the "onboard unit information" and "camera information" determined to relate to the same vehicle A from the onboard unit information table T1 and the camera information table T2 (step S304), and terminates the processing.

Also, when the "camera information" of which the "acquisition date and time" is within a predetermined time from the "acquisition date and time" of the "onboard unit information" is not recorded in the camera information table T2 (NO in step S305), or the "lane" of the "onboard unit information" and the "lane" of the "camera information" are different (NO in step S306), the same vehicle determination unit 214 determines whether "camera information" having "second license plate information", which matches a part of the "first license plate information" of the "onboard unit information", is recorded in the camera information table T2 (step S309). Specifically, when the degree of coincidence between the "first license plate information" and the "second license plate information" satisfies a predetermined condition, the same vehicle determination unit 214 determines that this "second license plate information" matches a part of the "first license plate information". In this embodiment, the degree of coincidence satisfying a predetermined condition means that the "first license plate information" and the "second license plate information" are matched in terms of a predetermined number of letters or more. For example, considering that the license plate information includes four letters, the same vehicle determination unit 214 determines that the degree of coincidence satisfies a predetermined condition in a case where three or more of them are matched. To give another embodiment, the same vehicle determination unit 214 can determine that the degree of coincidence satisfies a predetermined condition when a predetermined number of letters or less are mismatched between the "first license plate information" and the "second license plate information". In this case, for example, considering that the license plate information has four letters, the same vehicle determination unit 214 determines that the degree of coincidence satisfies a predetermined condition in a case where one of the four letters or less is mismatched.

When the "camera information" having "second license plate information" matched with a part of "first license plate information" of the "onboard unit information" is recorded in the camera information table T2 (YES in step S309), the same vehicle determination unit 214 determines that the "onboard unit information" and the "camera information" relate to the same vehicle A. Also, in this case, the same vehicle determination unit 214 determines that the license plate reader 230 fails to correctly read the "second license plate information" because of a dirty license plate of the vehicle A or the like. Specifically, the same vehicle determination unit 214 estimates that the "first license plate information" of the "onboard unit information" and "second license plate information" of the "camera information", relating to the same vehicle A, are of the same value, and under such estimation, determines that the "onboard unit information" and "camera information" of the vehicle A are "normal" (step S310).

For example, a description is given of the case that the same vehicle determination unit 214 extracts the "onboard unit information No. 3" of the onboard unit information table T1 (FIG. 3) in step S301. The same vehicle determination unit 214 searches the camera information table T2 for "camera information" acquired within a predetermined time from "acquisition date and time" ("2015/11/01 10:13") of the "onboard unit information No. 3". In this case, the "camera information No. 3" (FIG. 4) in the camera information table T2 has been acquired within a predetermined time from the "acquisition date and time" ("2015/11/01 10:14") of the "onboard unit information No. 3" (YES in step S305). However, since the "lane" ("L1") of the "onboard unit information No. 3" and the "lane" ("L2") of the "camera information No. 3" are different (NO in step S306), the same vehicle determination unit 214 further searches the camera information table T2 for "second license plate information" matched with a part of the "first license plate information" ("DDDD") of "onboard unit information No. 3". In the example of FIG. 4, the "second license plate information" ("DDDB") of the "camera information No. 3" in the camera information table T2 matches a part of the "first license plate information" ("DDDD") of the "onboard unit information No. 3" (YES in step S309). Thus, the same vehicle determination unit 214 determines that the "onboard unit information No. 3" and the "camera information No. 3" relate to the same vehicle A and the "onboard unit information No. 3" and "camera information No. 3" of the vehicle A are "normal" (step S310).

In this case, the same vehicle determination unit 214 deletes the "onboard unit information" ("onboard unit information No. 3") and "camera information" ("camera information No. 3"), which are determined to relate to the same vehicle A from the onboard unit information table T1 and the camera information table T2 (step S304), and terminates the processing.

Also, when the "camera information" having "second license plate information" matched with a part of "first license plate information" of the "onboard unit information" is not recorded in the camera information table T2 (NO in step S309), the same vehicle determination unit 214 determines that there is no "camera information" relating to the same vehicle A as a vehicle indicated by the "onboard unit information". Also, the same vehicle determination unit 214 determines that the vehicle A is an irregular vehicle ("suspected exchange of onboard unit (SUSPECT OF SWAP)") (step S311). Specifically, the onboard unit 10 with the "onboard unit information" may possibly be moved to a vehicle different from the vehicle identified by the "first license plate information" recorded previously in the onboard unit 10 (vehicle that cannot be identified by the "second license plate information").

For example, a description is given of the case that the same vehicle determination unit 214 extracts "onboard unit information No. 4" of the onboard unit information table T1 (FIG. 3) in step S301. In the example of FIG. 4, the camera information table T2 neither includes "camera information" acquired within a predetermined time from the "acquisition date and time" ("2015/11/01 10:30") of the "onboard unit information No. 4" (NO in step S305), nor "second license plate information" matched with a part of "first license plate information" ("EEEE") of the "onboard unit information No. 4" (NO in step S309). Thus, the same vehicle determination unit 214 determines that there is no "camera information" relating to the same vehicle A as a vehicle indicated by the "onboard unit information No. 4". Also, it determines that the vehicle A is an irregular vehicle ("suspected exchange of onboard unit (SUSPECT OF SWAP)") (step S311).

In this case, as illustrated in FIG. 5, the same vehicle determination unit 214 records information in which the "onboard unit information" is associated with its corresponding "details of irregularity" ("suspected exchange of onboard unit (SUSPECT OF SWAP)") of the vehicle A, as "irregular vehicle information" in the irregular vehicle table T3 ("irregular vehicle information No. 3" of FIG. 5) (step S312). Then, the same vehicle determination unit 214 deletes the "onboard unit information" from the onboard unit information table T1 (step S313), and terminates the processing.

Also, when the onboard unit information table T1 does not include "onboard unit information" being recorded for a time limit or more (NO in step S300), the same vehicle determination unit 214 proceeds to the processing A of FIG. 9.

As illustrated in FIG. 9, the same vehicle determination unit 214 determines whether the camera information table T2 includes "camera information" being recorded for a time limit or more (step S320).

When the camera information table T2 includes "camera information" being recorded for a time limit or more (YES in step S320), the same vehicle determination unit 214 extracts this "camera information" (step S321).

On the other hand, when camera information table T2 does not include "camera information" being recorded for a time limit or more (NO in step S320), the same vehicle determination unit 214 terminates the processing.

Next, the same vehicle determination unit 214 determines that there is no "onboard unit information" relating to the same vehicle A as a vehicle indicated by the "camera information" extracted in step S321. Also, the same vehicle determination unit 214 determines that the vehicle A is an irregular vehicle ("no onboard unit (NO OBU)") (step S322).

In this case, as illustrated in FIG. 5, the same vehicle determination unit 214 records information in which the "camera information" is associated with its corresponding "details of irregularity" ("no onboard unit (NO OBU)") of the vehicle A, as "irregular vehicle information" in the irregular vehicle table T3 ("irregular vehicle information No. 2" of FIG. 5) (step S323). Then, the same vehicle determination unit 214 deletes this "camera information" from the camera information table T2 (step S324), and terminates the processing.

Operational Effects

As described above, the same vehicle detection device 210 of this embodiment includes: the onboard unit information acquisition unit 211 configured to acquire the "first license plate information" of the vehicle A on the basis of the "onboard unit information" acquired through wireless communication with the onboard unit 10 in the vehicle A running on the lanes L1 and L2, and store the "onboard unit information" in the onboard unit information table T1; the camera information acquisition unit 213 configured to acquire the "camera information" including the "second license plate information" of the vehicle A that is read in on the basis of the image captured by the camera 220 configured to shoot a predetermined region, defined on the lanes L1 and L2, including the license plate of the vehicle A, and store the "camera information" in the camera information table T2; and the same vehicle determination unit 214 configured to determine whether the "onboard unit information" stored in the onboard unit information table T1 and the "camera information" stored in the camera information table T2 relate to the same vehicle.

Upon acquiring the "onboard unit information", in a case where the "camera information" including "second license plate information" that matches the "first license plate information" of the "onboard unit information" is recorded in the camera information table T2, the same vehicle determination unit 214 determines that the "onboard unit information" and the "camera information" relate to the same vehicle A.

Also, upon acquiring the "camera information", in a case where the "onboard unit information" having "first license plate information" that matches "second license plate information" of the "camera information" is recorded in the onboard unit information table T1, the same vehicle determination unit 214 determines that the "onboard unit information" and the "camera information" relate to the same vehicle A.

With the above processing, the same vehicle determination unit 214 can detect with high accuracy a combination of "onboard unit information" and "camera information" relating to the same vehicle A among the "onboard unit information" stored in the onboard unit information table T1 and the "camera information" stored in the camera information table T2 regardless of the order or timing of acquisition of the "onboard unit information" and "camera information".

Also, when the "camera information" having "second license plate information" that matches the "first license plate information" of the "onboard unit information" is not recorded in the camera information table T2, the same vehicle determination unit 214 determines that the "camera information" having "second license plate information" acquired at the same lane as the "lane" at which the "onboard unit information" is acquired, within a predetermined time from the "acquisition date and time" of the "onboard unit information", relates to the same vehicle A as a vehicle indicated by the "onboard unit information". Furthermore, when the "onboard unit information" having "first license plate information" that matches "second license plate information" of the "camera information" is not recorded in the onboard unit information table T1, the same vehicle determination unit 214 determines that the "onboard unit information" having "first license plate information" being acquired at the same lane as the "lane" at which the "camera information" is acquired, within a predetermined time from the "acquisition date and time" of the "camera information", relates to the same vehicle A as a vehicle indicated by the "camera information".

When the onboard unit is moved from the original vehicle to a new vehicle, the "first license plate information" (license plate information of the original vehicle) of the onboard unit may be different from the license plate information (license plate information of the new vehicle) of the vehicle in which the onboard unit is installed at present. In this case, the "first license plate information" of the "onboard unit information" acquired via the wireless communication device does not match the "second license plate information" of the "camera information" acquired via the license plate reader. In a case where the onboard unit is moved to another vehicle as such, the charging device is likely to erroneously recognize that the "onboard unit information" and the "camera information" relate to different vehicles. Consequently, the charging device may possibly fail to correctly charge a vehicle of which license plate information recorded in the onboard unit information and license plate information read with the license plate reader are not matched.

However, in this embodiment, as described above, the "onboard unit information" and "camera information" acquired within a predetermined time from the "acquisition date and time" at the same "lane", are determined to relate to the same vehicle A. Thus, even in a case where there is the vehicle A of which the "first license plate information"

of the "onboard unit information" and the "second license plate information" of the "camera information" are not matched due to the exchange of the onboard unit 10 or the like, the same vehicle determination unit 214 determines that the "onboard unit information" and the "camera information" relate to the same vehicle A. With the above processing, it is possible to detect a combination of "onboard unit information" and "camera information" relating to the same vehicle A with high accuracy.

Also, in a case where the "camera information" acquired within a predetermined time from the "acquisition date and time" of the "onboard unit information" at the same "lane" is not recorded in the camera information table T2, the same vehicle determination unit 214 determines that the "camera information" having "second license plate information" matched with a part of "first license plate information" of the "onboard unit information" relates to the same vehicle A as a vehicle indicated by the "onboard unit information". Moreover, when the "onboard unit information" acquired within a predetermined time from the "acquisition date and time" of the "camera information" at the same "lane" is not recorded in the onboard unit information table T1, the same vehicle determination unit 214 determines that the "onboard unit information" having "first license plate information" matched with a part of the "second license plate information" of the "camera information" relates to the same vehicle A as a vehicle indicated by the "camera information".

With the above processing, even in a case where a part of the "second license plate information" could not be correctly read because of a dirty license plate of the vehicle A or the like, when the "first license plate information" matched with a part of the "second license plate information" is found, the same vehicle determination unit 214 determines that the "camera information" having "second license plate information" and the "onboard unit information" having "first license plate information" relate to the same vehicle A. This makes it possible to detect a combination of "onboard unit information" and "camera information" relating to the same vehicle A with higher accuracy.

Also, when the "first license plate information" of the "onboard unit information" and "second license plate information" of the "camera information", determined to relate to the same vehicle A, are not matched, the same vehicle determination unit 214 determines that the vehicle A is an irregular vehicle.

With the above processing, the same vehicle detection device 210 can detect as an irregular vehicle, the vehicle A of which the "first license plate information" and the "second license plate information" are not matched because of the exchange of the onboard unit 10 or the like.

Furthermore, the same vehicle determination unit 214 records and stores "irregular vehicle information" in which the "onboard unit information" and "camera information" relating to the vehicle A determined to be an irregular vehicle are associated with its corresponding "details of irregularity" of the vehicle A, in the irregular vehicle table T3. With the above processing, an administrator or the like of a toll road can recognize the existence of an illegal vehicle with "onboard unit exchange", a vehicle that could not be correctly charged due to "no onboard unit", and the like, with reference to the "irregular vehicle table T3". Also, the administrator or the like of the toll road can perform additional charging processing for an owner or the like of the irregular vehicle and impose restriction such as prohibition of usage of the onboard unit 10 on the basis of the "onboard unit information" or "camera information" recorded in the "irregular vehicle table T3".

Also, the irregular vehicle processing unit 215 transmits the irregular vehicle information" stored by the same vehicle determination unit 214 to the management server 30 via a wide area network or the like. This allows an administrator or the like of a toll road to immediately recognize the existence of an illegal vehicle with "onboard unit exchange", a vehicle that could not be correctly charged because of "no onboard unit". Also, the administrator or the like of a toll road can perform additional charging processing for an owner or the like of the irregular vehicle and impose restriction such as prohibition of usage of the onboard unit 10 on the basis of the "onboard unit information" or "camera information" recorded in the received "irregular vehicle information".

Modification of First Embodiment

Figure 10:
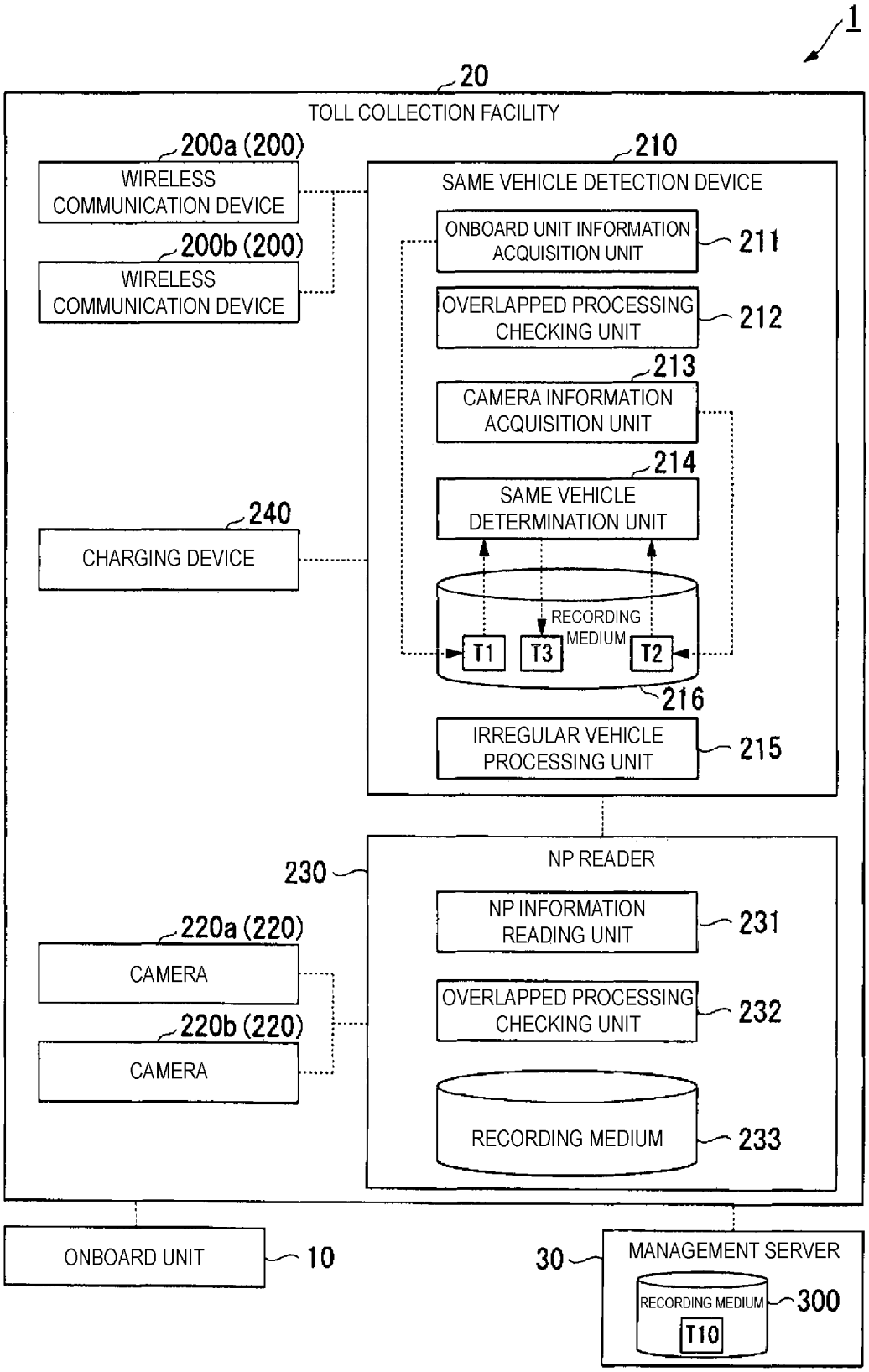
FIG. 10 is a diagram illustrating a functional configuration of a toll collection system according to a modification of the first embodiment of the present invention.

Referring to FIGS. 10 and 11, the toll collection system 1 according to a modification of the first embodiment of the present invention will be described next.

The same components as those in the above embodiments will be denoted by the same reference signs, and detailed descriptions thereof will be omitted.

This modification differs from the above embodiments in that the onboard unit information acquisition unit 211 acquires "first license plate information" from the management server 30.

Functional Configuration of Toll Collection System

FIG. 10 is a diagram illustrating a functional configuration of the toll collection system according to the modification of the first embodiment of the present invention.

FIG. 11 shows an example of an onboard unit information table according to the modification of the first embodiment of the present invention.

As illustrated in FIG. 10, the management server 30 includes a recording medium 300. As illustrated in FIG. 11, the recording medium 300 stores in advance an onboard unit registration table T10 in which "onboard unit registration information" including "onboard unit ID" of the onboard unit 10 and "first license plate information" for identifying a vehicle A with the onboard unit 10 are stored in association with one another.

In this embodiment, the onboard unit information acquisition unit 211 of the same vehicle detection device 210 acquires "onboard unit ID" and "credit card number" via the wireless communication device 200 from the onboard unit 10.

Then, the onboard unit information acquisition unit 211 records and stores the "onboard unit information" in which the acquired "onboard unit ID" and "credit card number" and the date and time (acquisition date and time) of acquisition of these information and its corresponding "lane" are associated, in the onboard unit information table T1 of the recording medium 216 (FIG. 3).

Also, the onboard unit information acquisition unit 211 communicates with the management server 30 via a wireless area network or the like and requests "first license plate information" associated with the acquired "onboard unit ID". The management server 30 selects the "first license plate information" associated with the "onboard unit ID", received from the same vehicle detection device 210, from the onboard unit registration table T10. Then, the management server 30 transmits the selected "first license plate information" to the same vehicle detection device 210.

The onboard unit information acquisition unit 211 adds the "first license plate information" received from the management server 30 to the "first license plate information" of the "onboard unit information" to update the onboard unit information table T1.

Operational Effects

As described above, the onboard unit information acquisition unit 211 of this modification records and stores the "onboard unit information" in which the "onboard unit ID" and "credit card information" acquired from the onboard unit 10 and the "first license plate information" acquired from the management server 30 are associated, in the onboard unit information table T1.

With the above processing, the onboard unit information acquisition unit 211 can store "onboard unit information" similar to that in the first embodiment, in the onboard unit information table T1.

Also, in this case, it is unnecessary to previously record the "first license plate information" in the onboard unit 10. Thus, upon moving the onboard unit 10 to a new vehicle, the "onboard unit information" can be kept updated through only such a simple processing as updating of the onboard unit registration table T10 of the management server 30 instead of a complicated processing such as rewriting of a recording medium (not illustrated) of the onboard unit 10. Also, it is unnecessary to acquire the "first license plate information" from the onboard unit 10 via the wireless communication device 200, leading to a saving of traffic between the acquisition unit and the onboard unit 10 so as to increase a traffic speed.

In the foregoing, certain embodiments of the present invention have been described, but these embodiments are merely illustrative and are not intended to limit the scope of the invention. These embodiments may be implemented in various other forms, and various omissions, substitutions, and alterations may be made without departing from the gist of the invention. These embodiments and modifications are included in the scope and gist of the invention and are also included in the scope of the invention described in the claims and equivalents thereof.

For example, the above embodiments have been described of such a mode that the toll road includes plural lanes (lanes L1 and L2) and the wireless communication device 200 (200*a*, 200*b*) and the camera 220(220*a*, 220*b*) are provided on the lanes on a one-to-one basis, but the present invention is not limited thereto. To give another embodiment, the toll road may have one lane or three or more lanes. In this case, one or three or more wireless communication devices 200 and cameras 220 can be provided according to the number of lanes.

Also, the above embodiments have been described of such a mode that the toll collection system 1 is provided at the exit tollgate of the toll road. To give another embodiment, however, it can be provided at the entrance tollgate.

Also, the above embodiments have been described of such a mode that image processing is performed on images captured by the camera 220 at regular intervals so as to detect vehicle's coming, and at this time of detection of vehicle's coming, an image for reading license plate information of this vehicle is captured, but the present invention is not limited thereto. The following is also conceivable: a vehicle detection device is provided in front of the gantry G in the lane direction (−X side of FIG. 1), and only when the vehicle detection device detects the vehicle A running on the lanes L1 and L2, the camera 220 captures an image for reading license plate information. As a result, every image captured by the camera 220 includes the license plate of the vehicle A and thus, the license plate reading processing with the license plate reader 230 can be simplified.

INDUSTRIAL APPLICABILITY

According to the aforementioned same vehicle detection device, toll collection facility, same vehicle detection method, and program, it is possible to detect information relating to the same vehicle from among a plurality of pieces of information acquired at different timings with high accuracy.

REFERENCE SIGNS LIST

1 Toll collection system
10 Onboard unit
20 Toll collection facility
200, 200*a*, 200*b* Wireless communication device
210 Same vehicle detection device
211 Onboard unit information acquisition unit (first license plate information acquisition unit)
212 Overlapped processing checking unit
213 Camera information acquisition unit (second license plate information acquisition unit)
214 Same vehicle determination device
215 Irregular vehicle processing unit
216 Recording medium
220, 220*a*, 220*b* Camera
230 License plate reader
231 License plate information reading unit
232 Overlapped processing checking unit
233 Recording medium
240 Charging device
A Vehicle
G Gantry
L1, L2 Lane

The invention claimed is:

1. A same vehicle detection device comprising a processor configured to execute processes of:

acquiring first license plate information of a vehicle running on a lane, based on onboard unit information acquired through wireless communication with an onboard unit installed in the vehicle, and storing the first license plate information in a first recording medium;

acquiring second license plate information of the vehicle that is read in, based on an image captured by a camera configured to shoot a predetermined region including a license plate of the vehicle, defined on the lane, and storing the second license plate information in a second recording medium;

deleting a latest first license plate information stored in the first recording medium if the latest first license plate information is same as the first license plate information stored in the first recording medium earlier than the latest first license plate information;

deleting a latest second license plate information stored in the second recording medium if the latest second license plate information is same as the second license plate information stored in the second recording medium earlier than the latest second license plate information;

selecting a second license plate information which is stored in the second recording medium and same as the latest first license plate information when the latest first license plate information is not deleted, and determining that the latest first license plate information and the selected second license plate information relate to the same vehicle, and selecting a first license plate information which is stored in the first recording medium and same as the latest second license plate information when the latest second license plate information is not deleted, and determining that the first license plate information and the second license plate information relate to the same vehicle.

2. The same vehicle detection device according to claim 1, wherein the processor further executes processes of:

in case that the first recording medium has an undeleted first license plate information which remains in the first recording medium more than a first time period from an acquisition time of the undeleted first license plate information, selecting a second license plate information which remains in the second recording medium and is acquired at the same lane as a lane at which the undeleted first license plate information is acquired within a second time period from the acquisition time of the undeleted first license plate information;

and determining that the undeleted first license plate information and the selected second license plate information are related to the same vehicle.

3. The same vehicle detection device according to claim 2, wherein the processor further executes processes of:

in case that a second license plate information acquired at the same lane as the lane at which the undeleted first license plate information is acquired does not exist, selecting a second license plate information which remains in the second recording medium and includes a portion which is same as a portion of the undeleted first license plate information.

4. The same vehicle detection device according to claim 2, wherein the processor further execute a process of:

in a case that the undeleted first license plate information and the selected second license plate information, determined to relate to the same vehicle, are different from each other, determining that the vehicle is an irregular vehicle.

5. A toll collection facility comprising:

a wireless communication device configured to perform wireless communication with an onboard unit installed in a vehicle running on a lane;

a license plate reader configured to read license plate information of the vehicle, based on an image captured by a camera configured to shoot a predetermined region including a license plate of the vehicle, defined on the lane;

the same vehicle detection device according to claim 1;

and a charging device configured to charge the vehicle, based on at least one of onboard unit information of the onboard unit, acquired via the wireless communication device and license plate information of the vehicle that is read by the license plate reader.

6. A same vehicle detection method comprising:

acquiring first license plate information of a vehicle running on a lane, based on onboard unit information acquired through wireless communication with an onboard unit installed in the vehicle, and storing the first license plate information in a first recording medium;

acquiring second license plate information of the vehicle that is read in, based on an image captured by a camera configured to shoot a predetermined region including a license plate of the vehicle, defined on the lane, and storing the second license plate information in a second recording medium;

and deleting a latest first license plate information stored in the first recording medium if the latest first license plate information is same as the first license plate information stored in the first recording medium earlier than the latest first license plate information;

deleting a latest second license plate information stored in the second recording medium if the latest second license plate information is same as the second license plate information stored in the second recording medium earlier than the latest second license plate information;

selecting a second license plate information which is stored in the second recording medium and same as the latest first license plate information when the latest first license plate information is not deleted, and determining that the latest first license plate information and the selected second license plate information relate to the same vehicle, and selecting a first license plate information which is stored in the first recording medium and same as the latest second license plate information when the latest second license plate information is not deleted, and determining that the selected first license plate information and the latest second license plate information relate to the same vehicle.

7. A non-transitory computer readable medium that stores a program causing a computer of a same vehicle detection device to function as:

acquiring first license plate information of a vehicle running on a lane, based on onboard unit information acquired through wireless communication with an onboard unit installed in the vehicle, and storing the first license plate information in a first recording medium;

acquiring second license plate information of the vehicle that is read in, based on an image captured by a camera configured to shoot a predetermined region including a license plate of the vehicle, defined on the lane, and storing the second license plate information in a second recording medium;

and deleting a latest first license plate information stored in the first recording medium if the latest first license plate information is same as the first license plate information stored in the first recording medium earlier than the latest first license plate information;

deleting a latest second license plate information stored in the second recording medium if the latest second license plate information is same as the second license plate information stored in the second recording medium earlier than the latest second license plate information;

selecting a second license plate information which is stored in the second recording medium and same as the latest first license plate information when the latest first license plate information is not deleted, and determining that the latest first license plate information and the selected second license plate information relate to the same vehicle, and selecting a first license plate information which is stored in the first recording medium and same as the latest second license plate information when the latest second license plate information is not deleted, and determining that the selected first license plate information and the latest second license plate information relate to the same vehicle.

* * * * *